United States Patent [19]

Atherton et al.

[11] 4,185,700

[45] Jan. 29, 1980

[54] CIRCLE MOUNTING AND CIRCLE ASSEMBLY FOR A MOTOR GRADER

[75] Inventors: Robert A. Atherton, Blue Grass, Iowa; Donald R. Berchtold; Gene B. Easterling, both of Decatur, Ill.

[73] Assignee: Caterpillar Tractor Co., Peoria, Ill.

[21] Appl. No.: 882,541

[22] Filed: Mar. 1, 1978

Related U.S. Application Data

[63] Continuation-in-part of Ser. No. 696,162, Jun. 14, 1976, abandoned.

[51] Int. Cl.[2] ..... E02F 3/76

[52] U.S. Cl. ..... 172/796; 74/448; 74/606 R

[58] Field of Search ..... 172/781, 788, 789, 791, 172/792, 793, 795, 796, 797; 212/70; 277/165; 308/187.1, 238, DIG. 8; 74/439, 446, 447, 448, 467, 606 R; 184/6.12

[56] References Cited

U.S. PATENT DOCUMENTS

| | | | |
|---|---|---|---|
| 299,883 | 6/1884 | Wallace | 74/447 |
| 711,991 | 10/1902 | Mason, Jr. | 74/447 |
| 1,190,365 | 7/1916 | Arndt | 172/796 |
| 1,325,778 | 12/1919 | Borden et al. | 74/448 |
| 1,384,623 | 7/1921 | Meredith | 74/448 |
| 1,498,809 | 6/1924 | Plunkett | 74/447 |
| 3,557,423 | 1/1971 | Wolfe et al. | 74/446 X |
| 3,612,538 | 10/1971 | Sievenpiper | 277/165 |
| 3,774,983 | 11/1973 | Lagally | 308/238 |
| 3,814,445 | 6/1974 | Bitzan | 277/165 |
| 4,015,669 | 4/1977 | Cole | 172/796 |

*Primary Examiner*—Richard T. Stouffer

*Attorney, Agent, or Firm*—Wegner, Stellman, McCord, Wiles & Wood

[57] ABSTRACT

An improved motor grader circle mounting and circle assembly has a mounting in which an annular upright wall with an outwardly extending integral top flange and a removable bottom flange form an outwardly open annular cavity. A circle structure of welded arcuate segments is rotatably mounted between the flanges and cooperates with the wall and flanges to form a close annular lubricant chamber, and a segmental internal ring gear is on the circle structure in the cavity. Renewable segmental lower and upper bearing plates are located between bearing surfaces of the circle mounting and the circle; and a lower oil sealing ring is so located as to permit removal of the bottom flange and lowering of the circle structure to replace all the bearing plates and a segmented upper oil seal without draining the lubricant chamber.

6 Claims, 4 Drawing Figures

Fig-1-
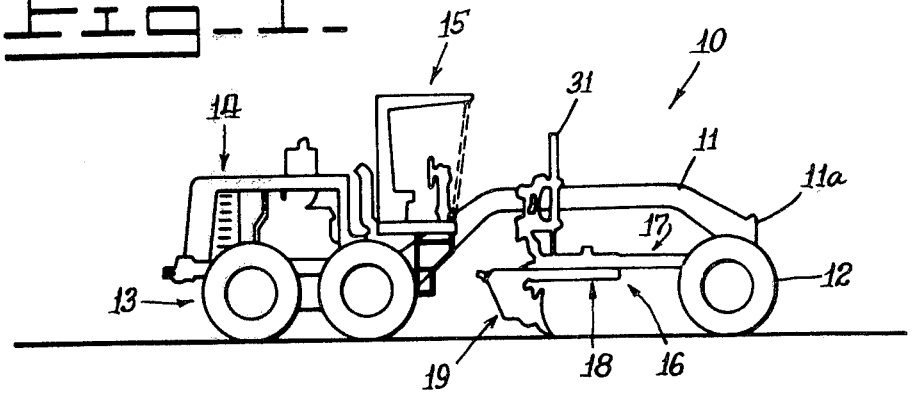
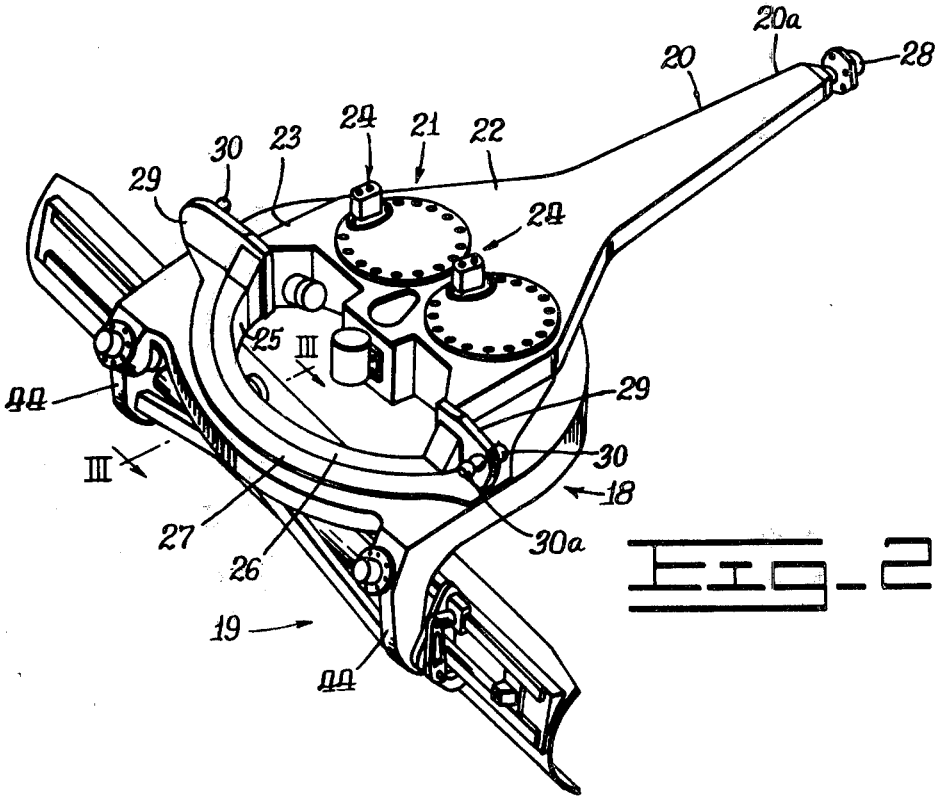
Fig-2-

CIRCLE MOUNTING AND CIRCLE ASSEMBLY FOR A MOTOR GRADER

CROSS-REFERENCE TO RELATED APPLICATIONS

This application is a continuation-in-part of applicants' copending application 696,162, filed June 14, 1976, now abandoned.

BACKGROUND OF THE INVENTION

The present invention is an improvement upon that of Carroll R. Cole U.S. Pat. No. 4,015,669, application for which was copending with application 696,162 of which this is a continuation-in-part.

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade.

Different types of circle draw bar and circle assemblies are illustrated in U.S. Pat. No. 2,799,099, 3,470,967 and 3,593,806. The structure of U.S. Pat. No. 4,015,669 is a great improvement upon them; but presents certain manufacturing and field servicing problems which are solved by the present improved structure.

SUMMARY OF THE INVENTION

A circle mounting bar and circle structure as disclosed in U.S. Pat. No. 4,015,669 is improved in the following respects:

1. The circle structure is fabricated from a plurality of circle segments which are welded to inwardly extending top and bottom webs of a channel-like ring. Such segments are much easier and less expensive to fabricate than is a single circle member.

2. The internal gear of the circle is also made from a plurality of segments which are seated upon a continuous step at the upper end portions of the circle segments, and bonded thereto. This, too, reduces manufacturing cost and permits the easy removal and replacement of a worn segment.

3. The lower portions of the circle segments have a horizontal supporting surface and a vertical in-facing surface which are complementary, respectively, to a bearing surface and a confronting surface of a removable bottom flange on the circle mounting, and segmental wear resistant lower plastic bearing plates are between the complementary surfaces. Said plates are most desirably fabricated from UHMW Polymer (ultrahigh molecular weight high density polyethylene), a product of Hercules, Incorporated, which requires no lubricant.

4. A wear resistant segmental plastic upper bearing strip is mounted in an annular groove in the top surfaces of the gear segments; and in addition an annular slot encircles the groove to receive a segmented upper sealing strip which is seated upon a resilient ring that biases the segmented sealing strip against the undersurface of the top flange of the circle mounting. Further, a lower sealing ring is between a first upright surface of the circle mounting and a second upright surface of the circle structure immediately above the removable bottom flange bearing surface, and quite close to the upper margin of the first upright surface.

The lower bearing plates may be easily replaced by supporting the circle structure on jacks or blocks and removing the circle supporting flange on which said bearing plates are carried. The location of the lower sealing ring makes it unnecessary to drain the lubricant chamber when performing this service.

Further, the height of the first upright surface is sufficient that the lubricant seal may remain in sealing contact with it while the circle structure is lowered far enough to replace the upper sealing strip and resilient ring, and the upper bearing strip.

THE DRAWINGS

FIG. 1 is a side elevational view of a motor grader embodying the invention;

FIG. 2 is a perspective view of a sub-assembly consisting of a circle mounting bar, a circle, and a grader blade, in which the circle mounting bar and circle assembly embody the present invention;

DETAILED DESCRIPTION OF THE INVENTION

Figure 4:
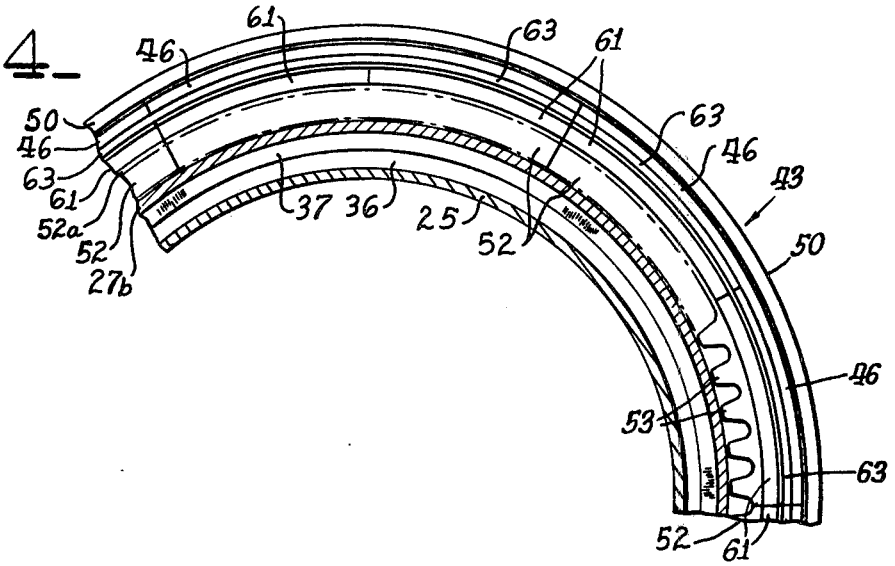
FIG. 4 is a fragmentary sectional view on a reduced scale, taken substantially as indicated along the line IV—IV of FIG. 3.
Figure 5:
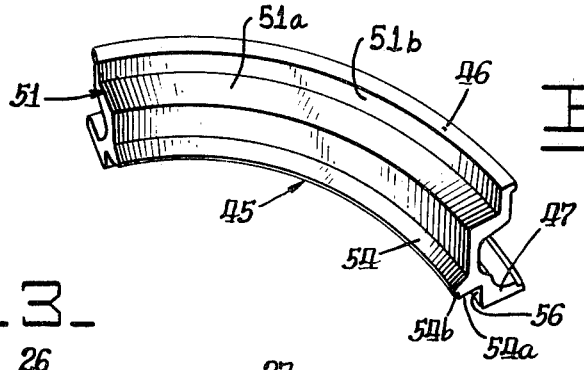
FIG. 5 is a perceptive view of one circle segment.

Referring first to FIG. 1 of the drawings, a motor grader, indicated generally at 10, includes a longitudinal main frame 11 the front end **11*a* of which is supported upon a dirigible front wheel assembly 12, and the rear end of which constitutes a part of a traction chassis, indicated generally at 13, on which is mounted a power plant, indicated generally at 14. An operator's cab, indicated generally at 15, is on the rear portion of the main frame, forward of the traction chassis. A grader blade sub-assembly, indicated generally at 16, consists generally of a circle mounting bar, indicated generally at 17, which in the illustrated apparatus is a draw bar; a circle structure, indicated generally at 18, and a grader blade and blade mounting, indicated generally at 19**.

The circle draw bar 17 is best seen in FIG. 2 to include a forward beam, indicated generally at 20, and a rearward circle mounting, indicated generally at 21, the forward part 22 of which is integral with the rear end of the beam 20. Behind the part 22 of the mounting said mounting has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is a horizontal top wall 26. An integral flange member 27 overlies the more inward portion of the circle.

The sub-assembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 31 which are carried upon the main frame 11. Thus, operation of the hydraulic cylinder units 31 swings the circle draw bar 17 about the ball and socket connection including the ball 28, which in this respect provides a horizontal pivot axis. A ball 30*a* on one of the webs 29 provides for a ball and socket connection with a side-shift cylinder (not shown) which shifts the draw bar sideways, with the ball 28 providing a vertical pivot axis.

Figure 3:
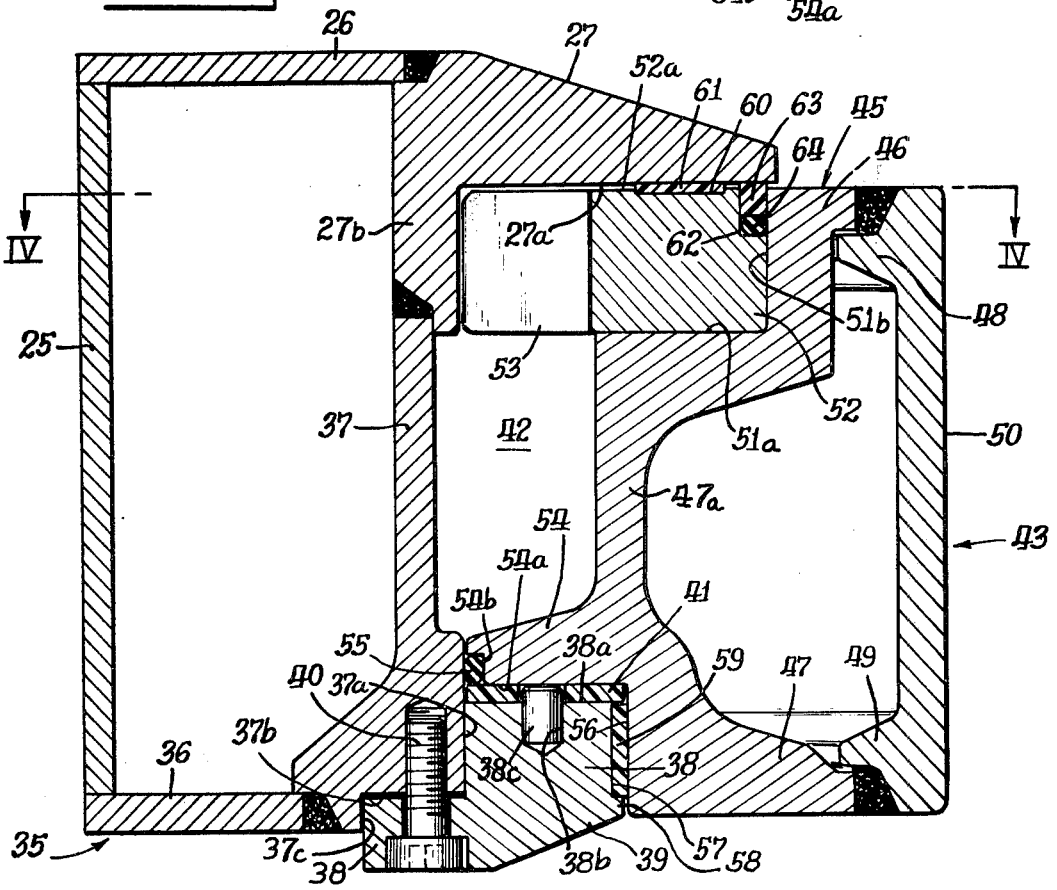
FIG. 3 is a fragmentary sectional view on an enlarged scale taken substantially as indicated along the line 3—3 of FIG. 2.

Referring now to FIG. 3, the semi-annular upright wall 25 and top wall 26 are seen to form two sides of a hollow member, indicated generally at 35, which also has a bottom wall 36 and an upright wall 37. The flange 27 is welded to the semi-annular top plate 26 and has a depending web 27*b* welded to the upright wall 37, so as to be structurally integral therewith. The flange 27 has an under side 27*a* which is machined to a fine finish so as to provide a bearing surface.

The upright wall 37 has a machined upright surface 37*a* near its lower end which provides a bearing surface of substantial height, and it also has a bottom surface 37*b* and a shoulder 37*c* which provide a mounting for an annular bottom flange member 38 which has a radially outwardly extending lip 39 which is in vertically spaced relationship to the integral flange 27 when the flange 38 is secured in place by means of a large number of circumferentially spaced machine screws 40 which screw into threaded bores in the lower end of the annular wall 37. The removable bottom flange 38 extends completely around beneath the top flange 27 and also beneath the bottom of the housing 23 so as to provide support for the entire circumference of the circle member 18. The removable bottom flange 38 has an upper bearing surface 38*a* which has spaced bores 38*b* to receive pins 38*c* which impale wear resistant plastic planar, lower bearing plate means 41 consisting of a plurality of arcuate bearing segments which surmount the bottom flange 38.

The bearing plate means 41, as well as other bearing elements hereinafter described, are preferably fabricated from UHMW Polymer, which is an ultrahigh molecular weight high-density polyethylene made by Hercules, Incorporated. UHMW Polymer is extremely wear resistant, and well suited to the environment of a motor grader. The wall 37, the top flange 27 and the removable bottom flange 38 cooperate to provide an outwardly open annular cavity 42.

The circle structure 18 is seen in FIGS. 2 to 5 to consist generally of a gear supporting body, indicated generally at 43, and blade beams 44 which are structurally integral with the gear supporting body 43. The gear supporting body 43 consists of a plurality of circle segments, indicated generally at 45, each of which has a top web 46 and a bottom web 47 connected by an upright web 47*a*. The circle segments 45 are placed end to end and welded to upper and lower internal flanges 48 and 49 of a ring 50 so that the gear carrying portion 43 generally takes the form of an annular box beam, or an annular I-beam with one side closed.

The top flange 46 of each circle segment 45 is provided with a step, indicated generally at 51, which is inwardly and upwardly open and has a supporting surface 51*a* and an upright confining surface 51*b*. Each step has an internal gear segment 52 having teeth such as those 53 which are seen in FIGS. 3 and 4; and such segments are positioned end to end on the supporting surfaces 51*a* abutting the confining surfaces 51*b* and bonded to the steps to form a complete internal gear.

As taught in U.S. Pat. No. 4,015,669, when the circle is mounted as seen in the drawings it closes the annular cavity 42 which can therefore be filled with lubricant.

The bottom flanges 47 of the circle segments 45 include an inwardly extending annular lip 54 having a finely finished supporting surface 54*a* which serves as a bearing surface that is supported upon the annular bearing means 41; and the inner end of the lip 54 has a shallow recess 54*b* to receive an oil seal 55. In addition, each circle segment 45 has a finely finished in-facing surface 56 which is perpendicular to the supporting surface 54*a*, and the bottom flange 38 has a peripheral confronting surface 57 with a bottom flange 58 that carries wear resistant plastic arcuate lower bearing plate segments 59. Thus, when the circle 18 is mounted in the outwardly open annular cavity 42, the load is carried by the segmental bearing plates 41 and 59.

Formed in the upper surface 52*a* of each gear segment 52 is a groove 60 which carries a wear resistant planar plastic top bearing plate segment 61; and encircling the groove 60 is a slot 62 for a segmental seal 63 which is biased against the undersurface 27*a* of the top flange 27 by an underlying resilient ring 64 to prevent entry of dust and dirt so as to protect the bearing surfaces 27*a*-60 and the ring gear teeth 53.

Using segments for those parts of the circle gear supporting body 43 which require finished surfaces simplifies the manufacture of the circle structure and eliminates the need for some very large machine tools; as does the use of the gear segments 52. Further, the segmental structures make it possible to replace a worn segment instead of an entire annular member; and this is especially important for the internal gear in which wear is normally confined to substantially less than 180° of the gear.

The segmental bearing plates 41, 59 and 61, and the segmental seal 63 are readily replaced in the field. The circle structure 43 may be supported on jacks or blocks to permit removal of the bottom flange 38 for replacement of the plates 41 and 59, with the lower oil seal 55 remaining in place to maintain the lubricant supply in the cavity 42. When it is necessary to inspect or replace the bearing plates 61, the segmental seal 63 or the resilient ring 62, the circle structure 43 may be lowered, with the lower oil seal 55 sliding along the surface 37*a*, until the top of the circle structure is accessible. To make this possible, the normal position of the lower seal 55 is a substantial distance above the lower end of the surface 37*a*, and the height of that surface is great enough to permit the insertion of necessary tools below the surface 27*a* of the top flange 27 when the circle structure 43 is lowered.

The foregoing detailed description is given for clearness of understanding only and no unnecessary limitations should be understood therefrom as modifications will be obvious to those skilled in the art.

The embodiments of the invention in which an exclusive property or privilege is claimed are defined as follows:

1. A motor grader circle mounting and circle assembly comprising, in combination:

a circle mounting comprising an annular, upright wall member, said wall member having a lower, continuous, circumferential, upright, outwardly facing, finished surface of predetermined height, an outwardly extending top flange which is integral with said wall member and has a bottom bearing surface, a bottom flange member which has a continuous circumferential, upright inwardly facing, finished surface, the height of which is a major portion of said predetermined height, and which bears against the lower part of said outwardly facing surface, a planar top surface, and a circumferential, upright outer face, and means detachably securing said bottom flange member to said upright wall member;

removable segmental planar, lower bearing plate means seated on said planar top surface;

removable segmental arcuate bearing plate means encircling said outer face;

a circle structure which has an inwardly extending, annular bottom lip with a shallow inner margin of a height which is a minor portion of said predetermined height and which is slightly spaced from the outwardly facing finished surface of the circle mounting wall member, said bottom lip having finished lower bearing surfaces abutting said planar bearing plate means and said arcuate bearing means, an upright web surrounding said upright wall member, a top web facing the top flange bearing surface, said circle mounting and said circle structure defining an annular lubricant chamber, and an internal gear mounted on said top web in said lubricant chamber;

a lower oil seal ring mounted on said shallow inner margin and sealing said space between said inner margin of said bottom lip and said upright, outwardly facing, finished surface;

segmental upper seal means surmounting said circle structure and bearing on the top flange bearing surface;

and segmental planar top bearing means surmounting the circle structure radially inwardly of said upper seal means and bearing on said top flange bearing surface, said bottom flange being removable to replace said segmental planar lower bearing plate means and said segmental arcuate bearing plate means without disturbing said lower oil seal ring.

2. The combination of claim 1 in which the inner margin of the circle structure bottom lip and the lower oil seal ring are immediately adjacent the top of said upright, outwardly facing finished surface and the predetermined height of said surface is great enough that the circle structure may be moved downwardly with said lower oil seal ring sliding in constant lubricant sealing engagement with said surface to permit replacement of said segmental planar top bearing means and said segmental upper seal means without releasing lubricant from said annular lubricant chamber.

3. The combination of claim 1 in which the annular bottom lip of the circle structure has a downwardly open peripheral notch in which the lower oil seal ring is seated substantially in contact with said planar, lower bearing plate means.

4. The combination of claim 1 in which there is an annular slot in the top of the circle structure, resilient means is seated in said slot, and the segmental upper seal means rests upon said ring and is biased thereby against the top flange bearing surface.

5. The combination of claim 4 in which the resilient means comprises an elastomeric ring.

6. The combination of claim 1 in which the circle structure consists of a plurality of arcuate segments welded together end to end, and the internal gear consists of a plurality of separate segments mounted end to end on, and bonded to the circle structure top web.

* * * * *